US010822939B2

(12) United States Patent
Hohl et al.

(10) Patent No.: US 10,822,939 B2
(45) Date of Patent: Nov. 3, 2020

(54) NORMALIZED STATUS VARIABLES FOR VIBRATION MANAGEMENT OF DRILL STRINGS

(71) Applicants: Andreas Hohl, Hannover (DE); Christian Herbig, Celle (DE); Hatem Oueslati, Hannover (DE); Hanno Reckmann, Nienhagen (DE); Michael Neubert, Braunschweig (DE)

(72) Inventors: Andreas Hohl, Hannover (DE); Christian Herbig, Celle (DE); Hatem Oueslati, Hannover (DE); Hanno Reckmann, Nienhagen (DE); Michael Neubert, Braunschweig (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 550 days.

(21) Appl. No.: 15/631,659

(22) Filed: Jun. 23, 2017

(65) Prior Publication Data

US 2018/0371889 A1 Dec. 27, 2018

(51) Int. Cl.
*E21B 44/00* (2006.01)
*E21B 47/12* (2012.01)
(Continued)

(52) U.S. Cl.
CPC ..... *E21B 44/00* (2013.01); *E21B 47/12* (2013.01); *E21B 44/005* (2013.01); *E21B 44/08* (2013.01); *E21B 47/095* (2020.05)

(58) Field of Classification Search
CPC ..... E21B 47/12; E21B 47/122; E21B 44/00; E21B 47/095; E21B 44/005; E21B 44/08
See application file for complete search history.

(56) References Cited

U.S. PATENT DOCUMENTS 4,514,797 A 4/1985 Begin
5,448,911 A 9/1995 Mason
(Continued)

FOREIGN PATENT DOCUMENTS

GB 2518982 A 8/2015

OTHER PUBLICATIONS

International Search Report and the Written Opinion of the International Searching Authority; PCT/US2018/038493; dated Oct. 15, 2018; 12 pages.

(Continued)

*Primary Examiner* — Gregory J Toatley, Jr.
*Assistant Examiner* — Lynda Dinh
(74) *Attorney, Agent, or Firm* — Cantor Colburn LLP

(57) ABSTRACT

Unwanted oscillations of a drill string while a borehole is being drilled are limited by adjusting a drilling parameter. Measurements related to oscillations of the drill string can be extrapolated by calculation to a position of interest along the drill string using a mode identified from one or more determined modes and a stability criterion that models the drill string. The stability criterion includes a specific modal damping for each of the one or more determined modes. The position of interest may correspond to a location of a tool or component that may be damaged by the unwanted oscillations. If the tool or component can be damaged by the oscillations as calculated, then the drilling parameter is adjusted to limit those oscillations.

19 Claims, 6 Drawing Sheets

(51) Int. Cl.
*E21B 47/095* (2012.01)
*E21B 44/08* (2006.01)

(56) References Cited

U.S. PATENT DOCUMENTS

| | | | | |
|---|---|---|---|---|
| 8,214,188 | B2 | 7/2012 | Bailey et al. | |
| 8,775,085 | B2 * | 7/2014 | Reckmann | E21B 47/007 702/9 |
| 8,977,523 | B2 * | 3/2015 | Ertas | E21B 44/00 703/2 |
| 9,382,761 | B2 | 7/2016 | Huang et al. | |
| 2011/0186353 | A1 * | 8/2011 | Turner | G01H 1/003 175/40 |
| 2013/0314241 | A1 | 11/2013 | Jamison et al. | |
| 2014/0251688 | A1 | 9/2014 | Turner et al. | |
| 2015/0083492 | A1 | 3/2015 | Wassell | |
| 2015/0083493 | A1 * | 3/2015 | Wassell | E21B 44/00 175/40 |
| 2015/0122547 | A1 | 5/2015 | Hohl et al. | |
| 2016/0348493 | A1 | 12/2016 | Hohl | |

OTHER PUBLICATIONS

Anderson, et al.; "Optimal Filtering"; 1979; Prentice-Hall, Inc. Englewood Cliffs, N.J.; part 1,pp. 1-197.

Anderson, et al.; "Optimal Filtering"; 1979; Prentice-Hall, Inc. Englewood Cliffs, N.J.; part 2, pp. 198-357.

Boussaada; et al; "Delay System Modeling of Rotary Drilling Vibrations"; 2016; Springer; 23 pages.

Gelb, et al. "Applied Optimal Estimation"; 1974; The Analytic Science Corporation; Reading Massachusetts; 192 pages.

Hohl, et al.; "Prediction and Mitigation of Torsional Vibrations in Drilling Systems"; IADC/SPE-178874-MS; Mar. 2016, IADC/SPE Drilling Conference and Exhibition; 15 pages.

Hohl, et al; "Derivation and Experimental Validation of an Analytical Criterion for the Identification of Self-Excited Modes in Drilling System"; Journal of Sound and Vibration 342; 2015; 13 pages.

Maybeck, Peter S.; "Stochastic Models, Estimation and Control"; 1979; vol. 1; Academic Press Inc.; 19 pages.

Oueslati, et al.; "New Insights Into Drilling Dynamics Through High-Frequency Vibration Measurement and Modeling"; SPE 166212; 2013; Society of Petroleum Engineers; 15 pages.

Peeters, et al; "Stochastic System identification for Operational Modal Analysis: A Review"; Journal of Dynamic Systems Measurement and Control; Dec. 2001; 26 pages.

Van Overschee, et al.; "SubSpace Identification for Linear Systems";1996; Kluwer Academic Publishers; Boston/London/Dordrecht; part 1 pp. 1-167.

Van Overschee, et al.; "SubSpace Identification for Linear Systems";1996; Kluwer Academic Publishers; Boston/London/Dordrecht; part 2, pp. 168-254.

* cited by examiner

NORMALIZED STATUS VARIABLES FOR VIBRATION MANAGEMENT OF DRILL STRINGS

BACKGROUND

Boreholes are drilled into earth formations for various purposes such as hydrocarbon production, geothermal production, and carbon dioxide sequestration. Typically, a borehole is drilled using a drill string having a drill bit. The drill string is rotated at the surface of the earth in order to rotate the drill bit, which cuts or disintegrates formation rock to form the borehole. Unfortunately, rotation of the drill string and the interaction of the drill bit with the formation rock can lead to severe oscillations that can damage the drill string components. Hence, it would be appreciated in the drilling industry if methods and apparatuses were developed that could limit severe oscillations of drill strings while boreholes are being drilled.

BRIEF SUMMARY

Disclosed is a method for adjusting a drilling parameter of a drill string. The method includes: determining with a processor one or more modes of the drill string using a mathematical model; sensing with a sensor at least one of a first oscillation amplitude at a first position in the drill string and an oscillation parameter of the drill string, different from the first oscillation amplitude, at the first position or a second position in the drill string to provide at least one of measured first oscillation amplitude data and measured oscillation parameter data; identifying with the processor a mode of the drill string using the one or more determined modes and a stability criterion and at least one of the measured first oscillation amplitude data and the measured oscillation parameter data, wherein the stability criterion includes a specific modal damping for each of the one or more determined modes; calculating with the processor an oscillation amplitude at a position of interest in the drill string using the identified mode and at least one of the measured first oscillation amplitude data, the measured oscillation parameter data and the stability criterion; and adjusting the drilling parameter in response to the calculated oscillation amplitude at the position of interest. One advantage of the method is to limit oscillations at the position of interest that may have a tool or component that can be damaged by the oscillations as calculated.

Also disclosed is an apparatus for adjusting a drilling parameter of a drill string. The apparatus includes: a sensor configured to sense at least one of a first oscillation amplitude at a first position in a drill string and an oscillation parameter of the drill string, different from the first oscillation amplitude, at the first position or a second position in the drill string to provide at least one of measured first oscillation amplitude data and measured oscillation parameter data; a processor; and a controller configured to adjust the drilling parameter in response to the calculated oscillation amplitude at the position of interest. The processor is configured to: determine one or more modes of the drill string using a mathematical model; identify a mode of the drill string using the one and more determined modes and a stability criterion and at least one of the measured first oscillation amplitude data and the measured oscillation parameter data, wherein the stability criterion includes a specific modal damping for each of the one or more determined modes; and calculate an oscillation amplitude at a position of interest in the drill string using the identified mode and at least one of the measured first oscillation amplitude data, the measured oscillation parameter data and the stability criterion. One advantage of the apparatus is to limit oscillations at the position of interest that may have a tool or component that can be damaged by the oscillations as calculated.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are embodiments of methods and apparatuses that limit severe oscillations of a drill string while a borehole is being drilled by selecting or controlling drilling parameters. Using an identified mode that accurately models the drill string, sensor measurements can be extrapolated to positions of interest along the drill string in order to determine the value at the position of interest of the same type of parameter being sensed. The term "mode" relates to a frequency of oscillations or vibration of the drill string and corresponding shape, referred to as a mode shape, of the drill string at that frequency. In one or more embodiments, the mode is an eigenmode that has an eigenfrequency. The positions of interest may correspond to locations of tools or components that may be damaged by severe vibrations. Hence, if an extrapolated value exceeds a limit of a tool, then a drilling parameter can be altered to lower the vibrations of the drill string and, consequently, lower the vibrations experienced at that tool. In order to determine if a change to a particular drilling parameter will be effective, a vibration amplitude at an excitation position such as a drill bit, also referred to a rock cutting structure, is normalized to a worst-case amplitude for the identified mode. A relatively small normalized amplitude at the excitation position with respect to the worst-case amplitude indicates that a change to the particular drilling parameter associated with excitation is not likely to result in a lowering of the vibration at the position of interest. Using this normalized value at the excitation position provides the advantage of eliminating or minimizing trial and error with respect to which drilling parameters to change to lower the vibrations.

In one example, low levels of vibrations may be measured, but nevertheless high levels of vibrations may be present in a bottomhole assembly located near the drill bit. The bottomhole assembly may include tools or components sensitive to the high levels of vibrations. The levels of vibrations at the tools or components may be estimated by extrapolating measured values of vibrations at one or more sensor locations using an identified mode shape that accurately models the drill string. The extrapolation may be based on an axial distance from the axial location of the sensor and/or a radial distance from the radial location of the sensor. Once extrapolated vibration levels that exceed tool or component vibration limits are identified, then actions can be taken to lower the amplitude of the drill string vibrations and, thus, prevent damage to the tools or components.

Figure 1:
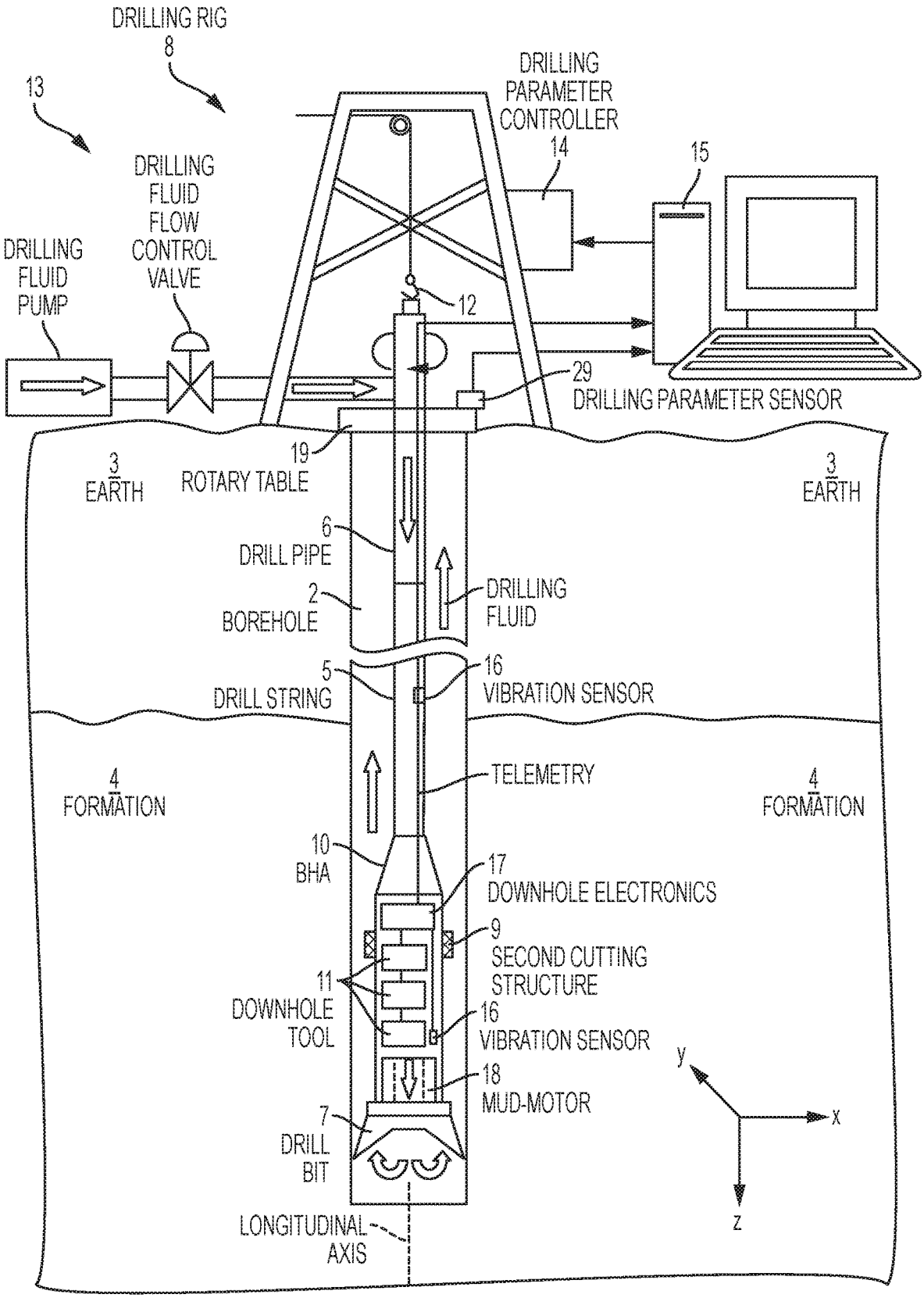
FIG. 1 is a cross-sectional view of an embodiment of a drill string disposed in a borehole penetrating the earth.

FIG. 1 is a cross-sectional view of an embodiment of a drill string 5 disposed in a borehole 2 penetrating the earth 3 having a formation 4. The drill sting 5 is made up of a series of drill pipes 6 that are connected together. A rock cutting structure or drill bit 7 that is configured to cut or disintegrate formation rock is disposed at the distal end of the drill string 5. The rock cutting structure 7 may represent a drill bit, a hole opener, and/or a reamer. A drill rig 8 is configured to conduct drilling operations such as rotating the drill string 5 and thus the drill bit 7 in order to drill the borehole 2. The drill rig 8 may include a drill string rotator 19, such as a rotary table, to rotate the drill string 5 at a desired rotational speed and/or torque. The drill rig 8 may also include a hook system 12 for lifting or supporting the drill string 5 in order to apply a desired weight-on-bit (WOB) downhole or hook load at the surface. The drill rig 8 may further include a drilling fluid system 13 for pumping drilling fluid through the interior of the drill string 5 in order to lubricate the drill bit 7 and flush cuttings from the borehole 2. A drill rig controller 14 is configured to control various drilling parameters of the drill rig 8 that apply force or energy to the drill string 5 for drilling the borehole 2. Non-limiting embodiments of these drilling parameters include WOB, hook load, applied drill string torque, and drilling fluid flow rate. The drill rig controller 14 may be configured to accept inputs manually from a drilling operator or automatically such as from a surface computer processing system 15. A bottomhole assembly (BHA) 10 is disposed on the drill string 5 generally near the drill bit 7. The BHA 10 may include a collar for containing one or more downhole tools 11 for evaluating the formation 4 and/or the borehole 2. In some embodiments, the BHA 10 may include the drill bit 7. In one or more embodiments, a mud-motor 18 may be coupled to the drill string 5 in order to provide additional rotational energy to the drill bit 7 by converting energy of flowing drilling fluid to the rotational energy. In one or more embodiments, a second rock cutting structure 9 such as a reamer may be coupled to the drill string 5 or the BHA 10. The second cutting structure 9 as with the drill bit 7 interacts with the formation 4 being drilled and may be a location that excites vibrations in the drill string 5.

The one or more downhole tools 11 may transmit data to a surface receiver such as the surface computer processing system 15 or receive commands from the surface using downhole telemetry such as wired drill pipe, mud-pulse telemetry, electromagnetic telemetry, or acoustic telemetry.

One or more sensors 16 configured to sense amplitudes of vibrations or oscillations over time may be disposed on the drill string 5 or the BHA 10. In one or more embodiments, one or more of the sensors 16 may be disposed near the drill bit 7 so as to sense vibrations or oscillations at a point of excitation of the drill string 5. The drill bit 7 may be considered a point of excitation due to interaction of the drill bit with formation rock as the formation rock is being drilled. Alternatively or in addition, the one or more sensors 16 may be configured to sense torque. Sensed data from the one or more sensors 16 may be transmitted to the surface receiver or surface computer processing system 15 for processing. Alternatively or in addition, sensor data may be processed downhole by downhole electronics 17, which may also provide an interface with a telemetry system.

One or more drilling parameter sensors 29 are configured to sense one or more drilling parameters used to drill the borehole 2. Data from the one or more drilling parameter sensors 29 may be processed by the computer processing system 15. Non-limiting embodiments of the drilling parameters that may be sensed include drill string rotational speed, mud-motor rotational speed, drill bit rotational speed, drill string torque, drilling fluid flow rate, hook-load, weight-on-bit, torque-on-bit, weight on a rock cutting structure, and torque on the rock cutting structure.

Figure 2:
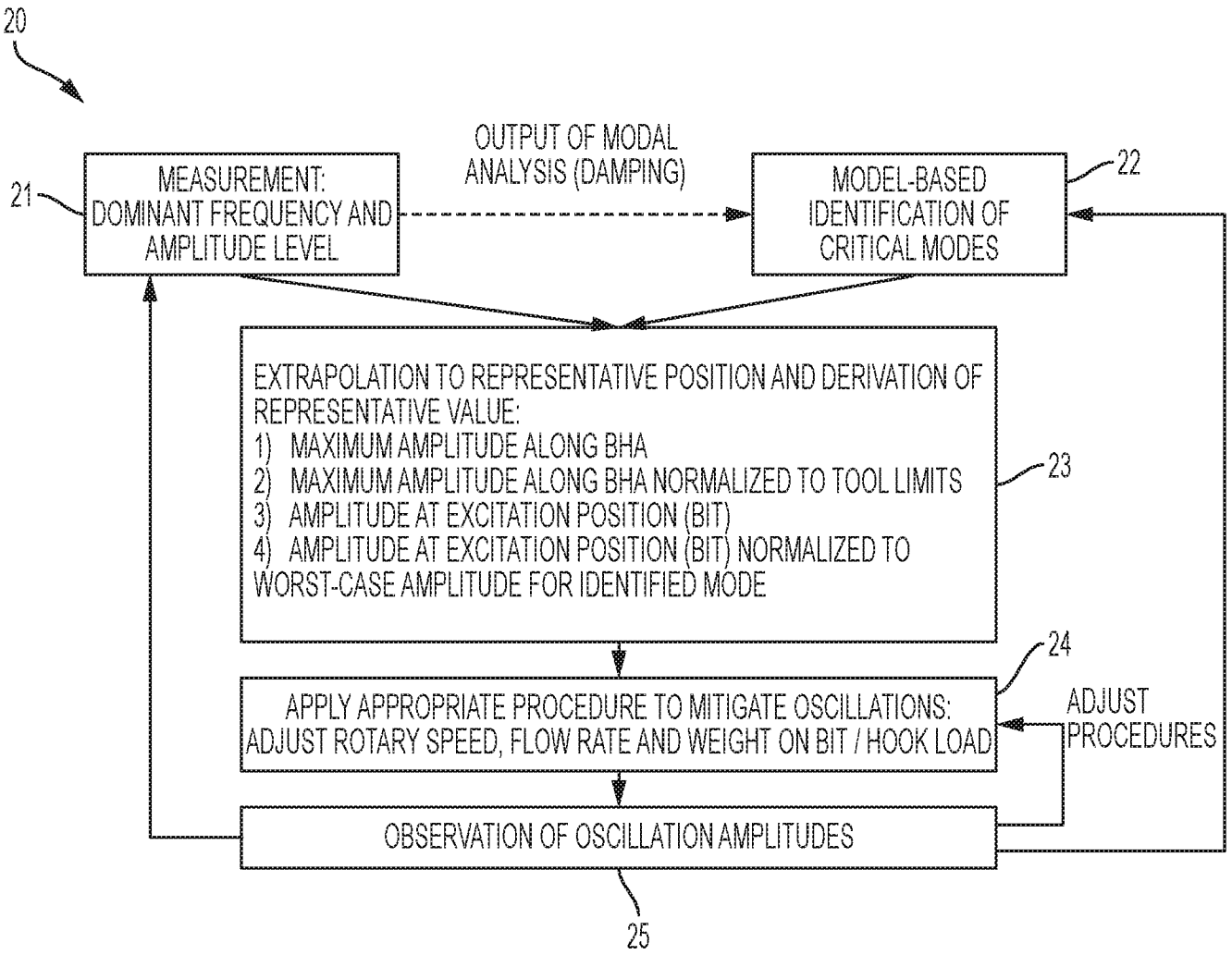
FIG. 2 is a block diagram of an overall procedure for reducing oscillations while drilling a borehole with the drill string.

FIG. 2 is a block diagram of an overall procedure 20 for reducing oscillations such as high frequency torsional oscillations (HFTO) while drilling a borehole with the drill string. Block 21 calls for performing vibration or oscillation amplitude measurements over time using the one or more sensors 16. From the sensor measurements the frequency content (at least one of amplitude and phase associated to a frequency) of the measurement is determined. Methods can be a Fourier transformation such as the discrete Fourier transformation or fast Fourier transformation or filter techniques (could be specified). The frequency can also be determined from the time signal if one frequency is dominant. Dominant amplitude levels and corresponding frequencies are determined from the frequency content. The dominant amplitude is often but not generally the greatest measured amplitude at the sensor position. The dominant frequency is generally the one that leads to the highest fluctuation of the rotational speed at the source of excitation, e.g. the bit. Damping may also be determined from the measurement data with some sort of modal analysis technique such as an operational modal analysis. The term "damping" relates to the ability of the drill string to dissipate energy as for example heat and, thus, decrease oscillation amplitudes. Damping can also be described as a modal damping value that is associated to a mode.

Block 22 calls for model-based identification of critical modes and determining a most-likely mode from the critical modes. Generally hundreds of modes can exist in the considered frequency range. Critical modes involve those modes that are most likely to be excited at the excitation position (e.g., bit) and tend to be instable. Instable means that the amplitude is increasing over time for example with an exponential function. Identification of critical modes from a mathematical model and involved parameters are discussed further below. In general, a most likely mode is identified by matching the frequency information from measurements with the eigenfrequencies of critical modes that are likely to be excited. Further the amplitude at different measurement positions can be matched with mode shapes of critical modes. For example the modal assurance criterion (measure of correlation between measured mode shapes and calculated mode shapes) can be used. Methods to determine mode shapes from measurements can be (operational/output only) modal analysis techniques. The eigenfrequency of a critical mode has an associated mode shape that is identified by a mathematical model.

All or a portion of the drill string 5 inclusive of the BHA 10 may be modeled using a finite element model (FEM) (i.e., a numerical model) in order to calculate the critical modes. Alternative numerical models include beam elements, three-dimensional solid elements, transfer matrix method mode, analytical models, Cosserat model, and lumped mass model.

Figure 3A:
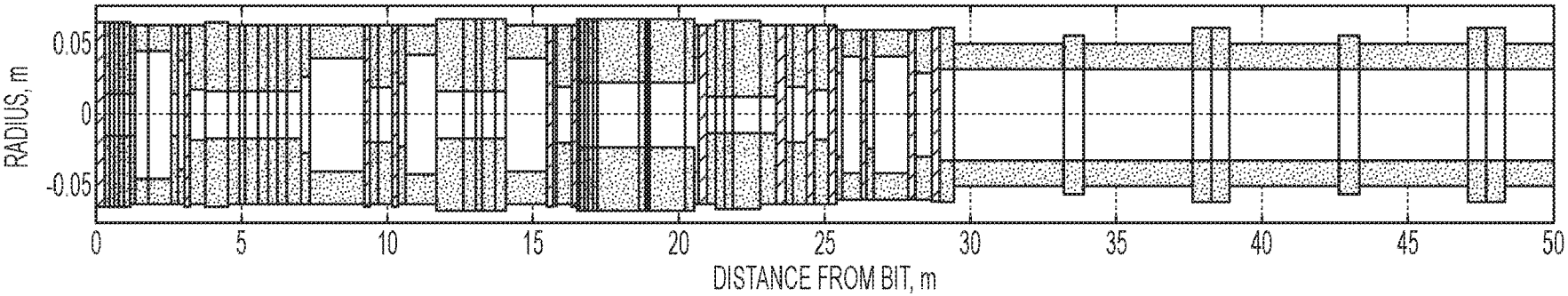
FIGS. 3A and 3B, collectively referred to as FIG. 3, depict aspects of the drill string and torsional mode shapes of the drill string.
Figure 3B:
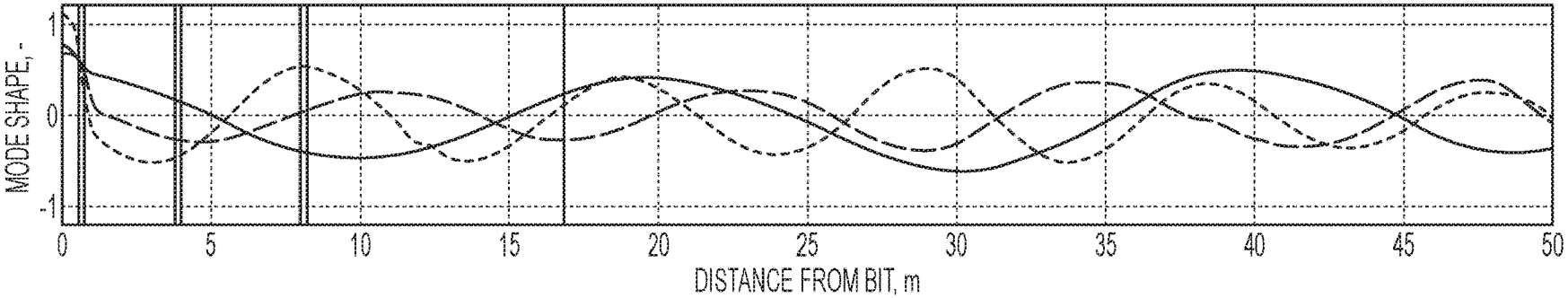

In most applications, beam elements are found to be appropriate to model the drilling system because of the ratio of the length and diameter of the structure. By modeling forces applied to the modeled drill string 5 at various frequencies and/or amplitudes at excitation points such as the drill bit or points of interaction with a wall of the borehole, various mode shapes and corresponding frequencies can be calculated. FIG. 3 depicts, by way of non-limiting example, aspects of a drill string and torsional mode shapes of the drill string. FIG. 3A provides a cross-sectional view of the BHA and part of the drill string that are modeled. FIG. 3B illustrates the calculated torsional mode shapes of the BHA and drill string that are most likely to be excited to provide the critical modes. It can be seen that the amplitudes of the modes shapes lead to small amplitudes at some positions and very high amplitudes at other positions. Measurements indicate that all of these mode shapes are excited consecutively. All modes and corresponding mode shapes are likely to be excited but only one is excited with very high corresponding amplitudes at one time. Therefore, the measured frequency of the torsional vibrations or oscillations can be used to identify the most-likely mode shape from the critical mode shapes.

Figure 4A:
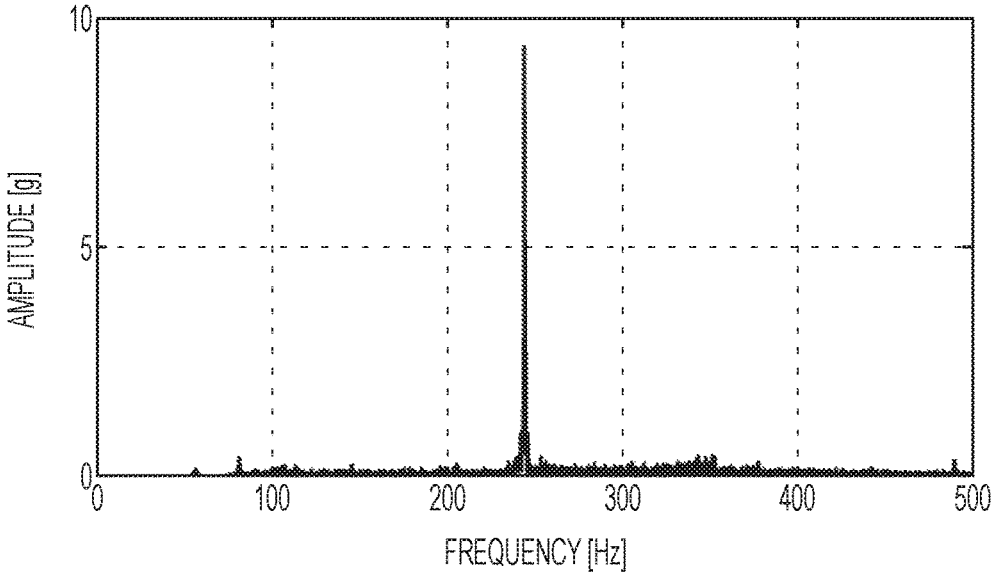
FIGS. 4A-4C, collectively referred to as FIG. 4, depict aspects of tangential accelerations at a drill bit of the drill string and corresponding rotary speed.
Figure 4B:
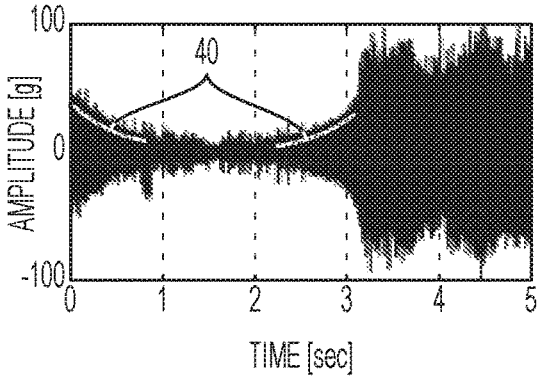
Figure 4C:
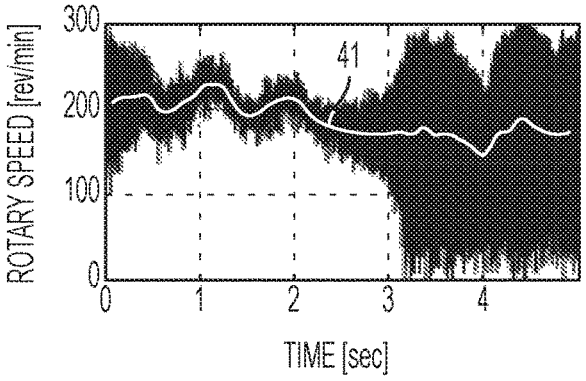

The frequency analysis of the torsional acceleration reveals the vibration of the BHA at specific discrete frequencies as illustrated in FIG. 4A. A finite element analysis of the drill string assembly, which may be inclusive of the BHA, is performed to calculate the torsional natural frequencies of the system. The excited frequencies in the field match the natural frequencies of a numerical analysis if appropriate boundary conditions are used. It has been established to use fixed torsional boundary conditions at the top drive and free boundary conditions at the bottom/bit end of the drilling assembly if the whole drilling system is modeled. Without the downhole motor, this also applies for high-frequency torsional oscillations. High-order normal modes of the drilling system with a downhole motor, however, are localized in the BHA. A torsional decoupling of the system at the downhole motor is a best practice for modeling of high-frequency torsional oscillations. Herein, the motor is divided into the substructures of the stator and the rotor that is theoretically decoupled from the stator for a relative rotational movement. In one or more embodiments, the BHA is modeled from the bit to the upper end of the rotor. The torsionally decoupled stator and the drilling system above the motor are not considered as a part of the structure. Free boundary conditions apply to the top and the bottom end (free bit) of the drilling assembly. Using these boundary conditions the finite element analysis (FEA) shows a very good agreement with the downhole measurements concerning the excited frequencies and the natural frequencies of the system. FIG. 4B illustrates vibration amplitude of the drill string versus time while FIG. 4C illustrates rotary speed of the drill string versus time. Rubber material between the rotor and stator of the mud-motor can be modeled to increase the accuracy in mud-motor applications. In FIG. 4B, line 40 is a fit of an exponential function to determine the damping ($\exp(-D*2*pi*f_0)$; where D is modal damping and $f_0$ natural frequency/eigenfrequency). In FIG. 4C, line 41 is the moving average of rotary speed of the drill string.

Figure 5:
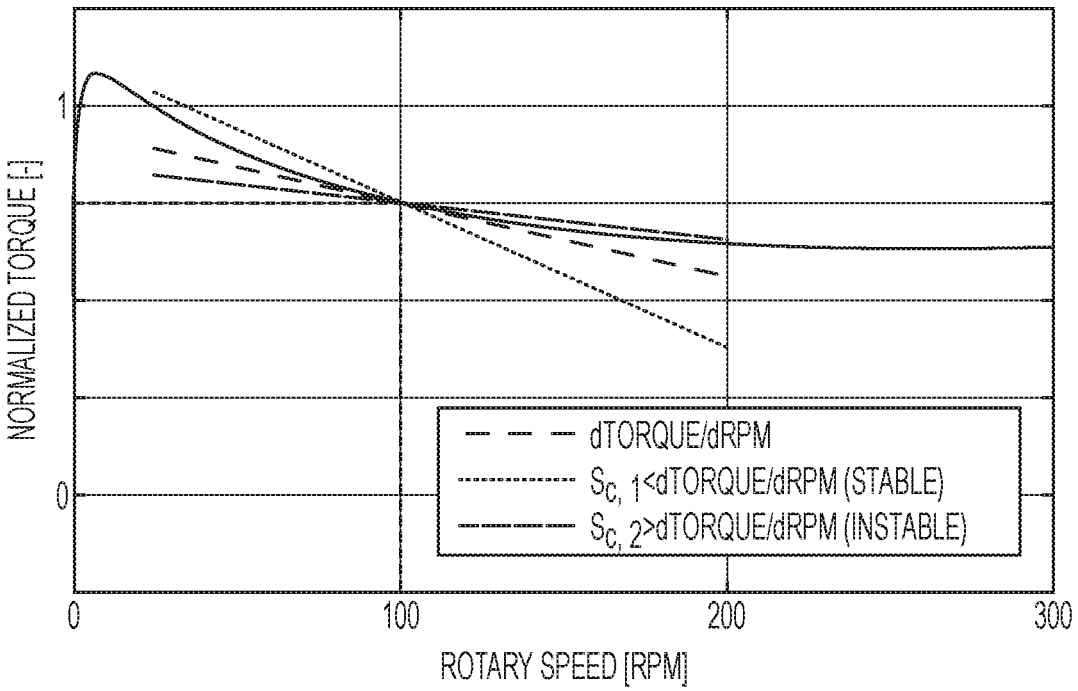
FIG. 5 depicts aspects of velocity weakening characteristic of cutting torque at a drill bit.

Critical modes are determined by a mathematical model and are the modes that are most likely to be instable. Different instability mechanisms can be considered such as mode coupling, regenerative effects and velocity weakening contact/cutting torques or forces. Description of derivation of critical modes with the assumption of a velocity weakening torque follows. Representative models that predict critical drilling parameters can only be derived from analysis of appropriate field measurements. To develop appropriate models for oscillations, such as e.g. HFTO, a dynamics measurement device with a usable frequency bandwidth up to 400 Hz was used, as a non-limiting example. The bandwidth may as well be higher or lower. It is also important to note that the measurement device needs a suitable arrangement of sensors, e.g. collocated sensors to distinguish between lateral, radial and tangential accelerations. An analytical stability criterion for the prediction of the self-excited torsional mode was derived. The criterion $$S_{c,k} = -\frac{2D_k\omega_{0,k}}{\varphi_k^2} < \frac{dTorque}{d\mathrm{RPM}}$$

is based on the comparison of the excitation caused by the velocity-weakening characteristic of the cutting torque at the bit with a slope $$\frac{dTorque}{d\mathrm{RPM}}$$

and the modal damping $D_k$ of the considered torsional mode k, as illustrated in FIG. 5. $S_{c,k}$ is the critical slope value for mode k. Stability is analyzed for an operating point with constant rotary speed (100 RPM FIG. 5) and constant bit torque. The equations are linearized with respect to this operating point. The criterion is dependent on the angular eigenfrequency $\omega_{0,k}$ and the deflection of the mass normalized eigenvector at the bit $\varphi_k$ that contributes quadratically. The actual slope of the torque characteristic $$\frac{dTorque}{d\mathrm{RPM}}$$

has to be greater (negative value) than the critical slope value $S_{c,k}$ for every mode k to achieve stable drilling. In an equivalent point of view this results in a positive effective modal damping of the considered mode.

FIG. 5 relates the actual torque at the bit to the critical slope value of two different modes. The dashed line represents the slope $$\frac{dTorque}{d\mathrm{RPM}}$$

of the torque characteristic at the operating point with a static torque and constant rotary speed (100 RPM). The straight solid line with the greatest declining slope in FIG. 5 indicates a critical slope value $S_{c,1}$ that corresponds to stable drilling. The other straight solid line with declining slope in FIG. 5 indicates a critical slope value $S_{c,2}$ that corresponds to instable drilling. The criterion can be determined for every torsional mode k and is used to rank the susceptibility of torsional modes to HFTO and stick/slip within a specific BHA. The susceptibility of two different BHAs can be ranked by comparison of the critical slope values of their most susceptible modes. The most susceptible mode of a BHA is given by $\max(S_{c,k})$. The modal damping value $D_k$ is specific for every mode and can only be derived from measurements e.g. with an operational modal analysis. If the modal damping value is unknown it is a source of uncertainty in the ranking.

According to the criterion, the stability of the drilling system with respect to self-excited torsional vibrations is dependent on modal properties represented by the critical slope value $S_{c,k}$ of the mode k and the shape of the velocity-weakening torque characteristic (FIG. 5). The velocity-weakening torque characteristic represented by dTorque/dRPM is dependent on formation properties and bit properties. Whereas formation properties cannot be changed, bit properties are commonly used in field applications to mitigate stick/slip. Similar stability criteria can be derived for other types of vibrations or oscillations, such as lateral or axial oscillations.

The natural frequency and mode shape are dependent on the geometry and material properties of the drilling system. Numerically the natural frequencies and mode shapes can be determined by a modal analysis of the finite element model of the structure described above. The modal damping $D_k$ can be estimated or determined by an experimental modal analysis. Additional damping is provided by the interaction of the mud and the drilling system.

The critical modes (mode shapes) and the corresponding amplitudes can now be identified for a specific BHA without measurements. The second critical point is the estimation of worst case amplitudes.

Similar to stick/slip the vibrational amplitudes of HFTO appear to be limited by backward-rotation of the bit as shown in a measurement of the rotational speed as illustrated in FIG. 4B. The physical reason are the positive slope of the bit torque characteristic for low rotary speeds and the sign change of the torque for bit backward rotation. Both mechanisms provide a high dissipation of energy and limit the amplitudes of HFTO.

Constant amplitude and harmonic fluctuation of the rotational speed and tangential vibrations at a natural frequency $f_{0,k}$ are assumed. In this case the maximum of the rotational speed of the bit due to a specific mode $\dot{\varphi}_{bit}=\hat{\varphi}\omega_{0,k}$ ($\ddot{\varphi}_{bit}=\hat{\varphi}\omega_{0,k}^2$) and the angular velocity of the bit $\dot{\varphi}_{RPM}$ have to be equal (this is the worst-case amplitude), $$\hat{\varphi}\omega_{0,k} = \dot{\varphi}_{bit} = \dot{\varphi}_{RPM} = \frac{2\pi}{60\frac{\text{sec}}{\text{min}}}\text{RPM} \rightarrow \hat{\varphi} = \frac{2\pi}{60\frac{\text{sec}}{\text{min}}}\text{RPM}\frac{1}{\omega_{0,k}}.$$

Herein, $\hat{\varphi}$ is the amplitude at the bit for a constant mean rotational speed in RPM and $\omega_{0,k}=2\pi f_{0,k}$ is the angular eigenfrequency of the critical mode. One contributing mode k is assumed. The worst-case amplitude can be influenced by stick/slip. The amplitudes and corresponding loads along the BHA can be extrapolated by the mode shape. A finite element model (beam elements, 3D solid elements) is built. The system matrices (stiffness, mass, damping optional) are defined. Possibly a state space model discrete or continuous is built from the system matrices. A numerical modal analysis is used to determine eigenvalues/natural frequency=eigenfrequency, damping values (only in case of the state space formulation) and mode shapes. The transfer matrix method can also be used to determine the natural frequency and mode shape. For simple geometries analytical models can be used to get analytical equations for the natural frequency and mode shape. Other approaches are the Cosserat model, finite difference model, or lumped-mass model. Other mathematical representations may also be used. Based on the modal analysis the $S_{c,k}$ values are used to rank the modes based in the equation above. Assumptions can be made for the damping values $D_k$ that can hardly be determined by models. If more than one mode is assumed to be critical the exponential increase $\exp(-D_k*2*pi*f_{0,k})$ can be used as an additional ranking. Modes with a higher value in the exponent tend to higher amplitudes faster and suppress other modes.

Block 23 in FIG. 2 calls for extrapolating measurements of the vibration amplitude to one or more positions of interest along the BHA and/or modeled drill string portion and determining one or more of: (1) a maximum amplitude along the BHA and/or modeled drill string portion at the one or more positions of interest; (2) a maximum amplitude along the BHA and/or modeled drill string portion at the one or more positions of interest normalized to a limit associated to the one or more positions of interest; (3) an amplitude at an excitation position; and (4) an amplitude at an excitation position normalized to a worst case amplitude.

Block 24 calls for adjusting a drilling parameter in response to the normalized amplitude value meeting or exceeding a threshold normalized value. In one or more embodiments, the threshold normalized value is 90%, thereby providing a 10% margin to the tool limit. The drilling parameter to be adjusted may be selected using the normalized excitation amplitude. The normalized excitation amplitude provides an indication of potential effectiveness of adjusting a specific drilling parameter. See for example FIG. 4, which illustrates torsional amplitude versus time and the corresponding rotary speed versus time measured at the drill bit. After about 3 seconds, the torsional vibrations significantly increase and the corresponding rotary speed varies about plus or minus 150 rpm with respect to the average rpm, thus indicating that decreasing the rpm will most likely result in lowering the torsional vibrations. In one or more embodiments, there is a linear relationship between drill string rotary speed and the amplitude of high frequency torsional oscillations. Similar correlations can be developed for other drilling parameters using the vibration measurements and known values of drilling parameters in order to determine the likelihood of adjustment of other drilling parameters.

Block 25 calls for performing further vibration or oscillation amplitude measurements over time using the one or more sensors 16 in response to adjustment of the drilling parameter. These further measurements can provide feedback as to the effectiveness of the adjustment of the drilling parameter. If the normalized amplitude value has not decreased a desired amount for the one or more positions of interest, then further adjustment of the drilling parameter may be required. Alternatively or in addition, another drilling parameter may be adjusted. Based on the response of the vibrations to the adjustment of the drilling parameter as determined by the further measurements, the FEA model and/or the applied forces may be adjusted to provide for more accurate modelling using an updated model. The updated model may be further refined using an updated damping value determined from the further measurements.

It can be appreciated that in one or more embodiments a Kalman filter may be used to estimates states inclusive of vibration of the drill string. The Kalman filter combines all available measurement data, plus prior knowledge about the drill string system and sensors such as sensor inaccuracies, to produce an estimate of desired variables in such a manner that error is minimized statistically. The Kalman filter may be implemented by the surface computer processing system 15 and/or the downhole electronics 17 in non-limiting embodiments.

Figure 6:
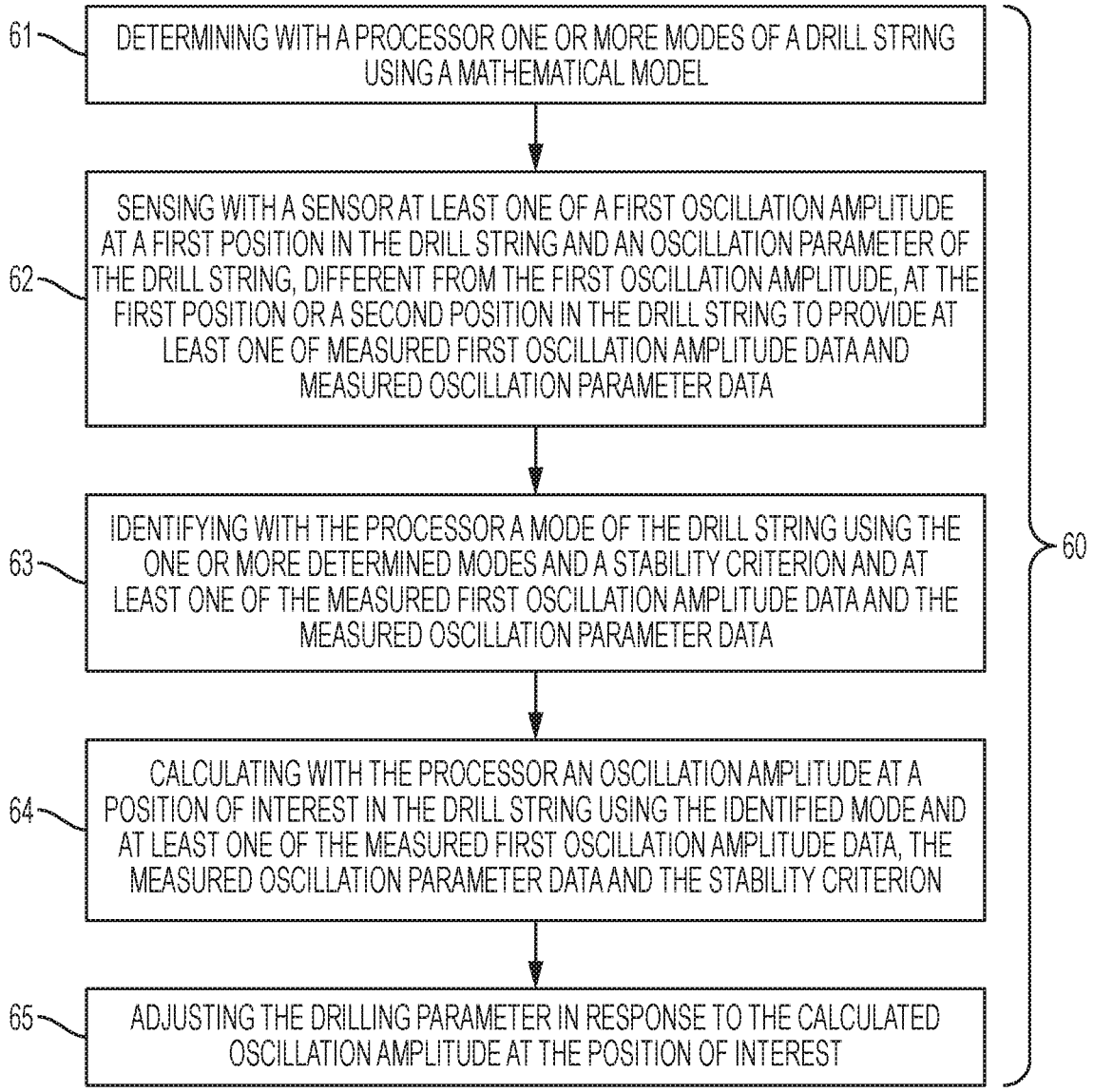
FIG. 6 is a flow chart for a method for controlling a drilling parameter of a drill string.

FIG. 6 is a flow chart for a method 60 for adjusting a drilling parameter of a drill string. The term "drill string" in FIG. 6 is inclusive of a BHA and/or at least a portion of the drill string. Block 61 calls for determining with a processor one or more modes of the drill string using a mathematical model. In one or more embodiments, the mode are associated with the critical modes as discussed above. The critical modes may be associated with resonant frequencies in which the amplitudes are significantly higher than at other non-resonant frequencies.

Block 62 calls for sensing with a sensor at least one of a first oscillation amplitude at a first position in the drill string and an oscillation parameter of the drill string, different from the first oscillation amplitude, at the first position or a second position in the drill string to provide at least one of measured first oscillation amplitude data and measured oscillation parameter data. In one or more embodiments, oscillation amplitudes (including torsional oscillation amplitudes) can be measured or characterized by angular accelerations, tangential acceleration amplitudes (e.g., angular acceleration multiplied by a reference radius), and/or dynamic torque. In one or more embodiments, the position of the oscillation sensor may be located within a BHA and placed a known radial distance from the center line of the BHA or drill string. In one or more embodiments, the sensor may be at least one of an accelerometer, a bending moment sensor, a displacement sensor, a strain sensor, a magnetometer, and/or a velocity sensor. In one or more embodiments, the oscillation parameter of the drill string, different from the first oscillation amplitude is at least one of a second oscillation amplitude at a second position in the drill string, a rotary speed of a rock cutting structure in the drill string, and an oscillation frequency at the first position in the drill string. Non-limiting embodiments of the rock cutting structure include at least one of a drill bit, a hole opener, and a reamer. In one or more embodiments, sensing the first oscillation amplitude to provide measured first oscillation amplitude data includes sensing acceleration, bending moment, displacement, velocity, torque, strain, and/or stress.

Block 63 calls for identifying with the processor a mode of the drill string using the one or more determined modes and a stability criterion and at least one of the measured first oscillation amplitude data and the measured oscillation parameter data. In one or more embodiments, the identified mode is a predominant mode that may be related to a predominant amplitude level. The predominant amplitude level is the highest sensed amplitude value, which occurs at a certain frequency. The predominant mode can also be the one that leads to a dominant fluctuation of the bit rotary speed. The predominant mode might not be measured with the highest amplitude, if the corresponding mode shape has a low amplitude at the sensor positions near to a node. That is, the frequency associated with the dominant amplitude level can used to select or identify which of the one or more modes is the predominant mode. The predominant mode can be determined using a model of the drilling system. This is done by comparing the natural frequency of the critical modes with the frequency associated with the predominant amplitude level. In one or more embodiments, the stability criterion includes a modal damping of the one or more modes of the drill string. The stability criterion may further include at least one of an eigenfrequency of the one or more modes, a deflection, and a force. Mode shapes or deflection shapes information can also be compared between measurements (e.g., ratio of amplitudes at different sensor positions) and the critical modes determined by the mathematical model described above. If more than one measurement position exists, the mode shape can be estimated by the ratio of measurements between different measurement positions. Other methods to determine a mode shape and a natural frequency of a mode are (operational or input only) modal analysis or generally system identification methods. The excited frequency spectrum can be determined by a Fourier analysis, fast Fourier transformation (FFT), power spectral density (PSD) which is based on the Fourier transformation. Different length of samples in the used time signal with different sampling frequencies can be used. This leads to a different frequency resolution and time resolution of the frequency information. A suitable frequency and time resolution can be used to capture the frequency content that is most likely be excited.

Block 64 calls for calculating with the processor an oscillation amplitude at a position of interest in the drill string using the identified mode and at least one of the measured first oscillation amplitude data, the measured oscillation parameter data and the stability criterion. In one or more embodiments, the position of interest in the drill string is a position of a downhole tool. The calculating may include extrapolating a measured value to one or more positions along the drill string. The extrapolating may be (1) axial along the center line of the BHA and/or drill string and/or (2) radial along an axis extending radially from the centerline of the BHA and/or drill string. Radial extrapolation may be a linear extrapolation to account for a difference between the radial position of the sensor and the radial position of the position of interest. In one or more embodiments, the extrapolated oscillation amplitude at the position of interest is a torsional oscillation amplitude. In one or more embodiments, the calculated amplitude at the position of interest is a normalized torsional oscillation amplitude, normalized to a torsional oscillation limit of the component at the position of interest. The normalized maximum torsional oscillation amplitude may be calculated as a ratio value (e.g., maximum torsional oscillation amplitude/tool limit) or as a percentage in one or more non-limiting embodiments. In one or more embodiments, the oscillation amplitude may be normalized to a selected amplitude. A non-limiting embodiment of the selected amplitude is a worst-case amplitude or within a selected range of the worst-case amplitude.

Block 65 calls for adjusting the drilling parameter in response to the calculated oscillation amplitude at the position of interest. In one or more embodiments, the processor may transmit a signal to a surface receiver using a transmitter (e.g. the downhole electronics). In one or more embodiments, the signal is at least one of the measured first oscillation amplitude data, the measured oscillation parameter data and the calculated oscillation amplitude. In one or more embodiments, the processor may transmit a signal to a controller, located either at the surface or downhole, to automatically adjust the drilling parameter. In one or more embodiments, the processor may transmit a signal to a user interface so that the user can manually adjust the drilling parameter. In this case, the controller can be configured to accept manual input from the user such as a drilling operator. Non-limiting embodiments of the drilling parameter include at least one of drill string rotational speed, mud-motor rotational speed, drill bit rotational speed, drill string torque, drilling fluid flow rate, hook-load, weight-on-bit, torque-on-bit, weight on a rock cutting structure, and torque on the rock cutting structure. In one or more embodiments, adjusting may include adjusting the drilling parameter in response to the calculated oscillation amplitude at the position of interest exceeding a predefined threshold using a controller configured to adjust the drilling parameter. In one or more embodiments, adjusting may include adjusting the drilling parameter in response to the excitation oscillation amplitude at the excitation position. In one or more embodiments, the excitation position is at the rock cutting structure coupled to the drill string.

The method 60 may also include: extrapolating with the processor a sensed first oscillation amplitude to an excitation position using a predominant mode to provide an excitation oscillation amplitude at the excitation position; and calculating, by the processor, a maximum excitation oscillation amplitude at the excitation position. In one or more embodiments, the maximum excitation oscillation amplitude at the excitation position is a normalized amplitude that is normalized to a selected amplitude at the excitation position. In one or more embodiments, the selected amplitude is a worst-case amplitude or within a selected range of the worst-case amplitude. The method 60 may further include selecting the drilling parameter in response to the normalized maximum excitation oscillation being less than a normalized excitation oscillation threshold. That is, a higher normalized maximum excitation oscillation amplitude (near to the worst case amplitude, e.g., within 10-20%) indicates that the selected drilling parameter will likely reduce the oscillation amplitude at the excitation position if adjusted. In one or more embodiments, the selected amplitude to be normalized to is a worst-case amplitude or maximum possible amplitude. The normalized maximum excitation oscillation amplitude may be present as a ratio value or a percentage value in one or more embodiments.

The method 60 may further include recording the measured first oscillation amplitude data versus time and the drilling parameter versus time and using the recordings to determine a correlation between variations of measured first oscillation amplitude data and variations in a value of the drilling parameter. The method 60 may further include selecting the drilling parameter based on the correlation exceeding a correlation threshold value.

Set forth below are some embodiments of the foregoing disclosure:

Embodiment 1. A method for adjusting a drilling parameter of a drill string, the method comprising: determining with a processor one or more modes of the drill string using a mathematical model; sensing with a sensor at least one of a first oscillation amplitude at a first position in the drill string and an oscillation parameter of the drill string, different from the first oscillation amplitude, at the first position or a second position in the drill string to provide at least one of measured first oscillation amplitude data and measured oscillation parameter data; identifying with the processor a mode of the drill string using the one or more determined modes and a stability criterion and at least one of the measured first oscillation amplitude data and the measured oscillation parameter data; calculating with the processor an oscillation amplitude at a position of interest in the drill string using the identified mode and at least one of the measured first oscillation amplitude data, the measured oscillation parameter data and the stability criterion; and adjusting the drilling parameter in response to the calculated oscillation amplitude at the position of interest.

Embodiment 2. The method according to any prior embodiment, wherein the oscillation parameter of the drill string, different from the first oscillation amplitude is at least one of a second oscillation amplitude at a second position in the drill string, a rotary speed of a rock cutting structure in the drill string, and an oscillation frequency at the first position in the drill string.

Embodiment 3. The method according to any prior embodiment, wherein the rock cutting structure is at least one of a drill bit, a hole opener, and a reamer.

Embodiment 4. The method according to any prior embodiment, wherein the stability criterion comprises a modal damping of the one or more modes of the drill string.

Embodiment 5. The method of any prior embodiment, wherein the stability criterion comprises at least one of an eigenfrequency of the one or more modes, a deflection, and a force.

Embodiment 6. The method according to any prior embodiment, wherein adjusting comprises adjusting the drilling parameter in response to the calculated oscillation amplitude at the position of interest exceeding a predefined threshold using a controller configured to adjust the drilling parameter.

Embodiment 7. The method according to any prior embodiment, wherein the calculated oscillation amplitude at the position of interest is a torsional oscillation amplitude.

Embodiment 8. The method according to any prior embodiment, further comprising extrapolating with the processor a sensed first oscillation amplitude to an excitation position using a predominant mode to provide an excitation oscillation amplitude at the excitation position.

Embodiment 9. The method according to any prior embodiment, further comprising adjusting the drilling parameter in response to the excitation oscillation amplitude at the excitation position.

Embodiment 10. The method according to any prior embodiment, further comprising calculating with the processor a normalized excitation oscillation amplitude at the excitation position normalized to a selected amplitude at the excitation position.

Embodiment 11. The method according to any prior embodiment, wherein the selected amplitude is a worst-case amplitude or within a selected range of the worst-case amplitude.

Embodiment 12. The method according to any prior embodiment, further comprising transmitting with a transmitter a signal to a surface receiver.

Embodiment 13. The method according to any prior embodiment, wherein the signal is at least one of the measured first oscillation amplitude data, the measured oscillation parameter data and the calculated oscillation amplitude.

Embodiment 14. The method according to any prior embodiment, wherein the drilling parameter comprises at least one of drill string rotational speed, mud-motor rotational speed, drill bit rotational speed, drill string torque, drilling fluid flow rate, hook-load, weight-on-bit, torque-on-bit, weight on a rock cutting structure, and torque on the rock cutting structure.

Embodiment 15. The method according to any prior embodiment, wherein the position of interest in the drill string is a position of a downhole tool.

Embodiment 16. The method according to any prior embodiment, wherein sensing the first oscillation amplitude to provide measured first oscillation amplitude data comprises sensing at least one of acceleration, bending moment, displacement, velocity, torque, strain, and stress.

Embodiment 17. The method according to any prior embodiment, further comprising recording the drilling parameter versus time and at least one of the measured first oscillation amplitude data versus time and the measured oscillation parameter data versus time; further using the recordings to determine a correlation between variations in a value of the drilling parameter and at least one of variations of the measured first oscillation amplitude data and variations of the measured oscillation parameter data.

Embodiment 18. An apparatus for adjusting a drilling parameter of a drill string, the apparatus comprising: a sensor configured to sense at least one of a first oscillation amplitude at a first position in a drill string and an oscillation parameter of the drill string, different from the first oscillation amplitude, at the first position or a second position in the drill string to provide at least one of measured first oscillation amplitude data and measured oscillation parameter data; a processor configured to: determine one or more modes of the drill string using a mathematical model; identify a mode of the drill string using the one and more determined modes and a stability criterion and at least one of the measured first oscillation amplitude data and the measured oscillation parameter data; and calculate an oscillation amplitude at a position of interest in the drill string using the identified mode and at least one of the measured first oscillation amplitude data, the measured oscillation parameter data and the stability criterion; a controller configured to adjust the drilling parameter in response to the calculated oscillation amplitude at the position of interest.

Embodiment 19. The apparatus according to any prior embodiment, wherein the controller is configured to automatically adjust the drilling parameter in response to the calculated oscillation amplitude at the position of interest.

Embodiment 20. The apparatus according to any prior embodiment, wherein the controller is configured to accept manual input from a user that receives the calculated oscillation amplitude at the position of interest.

In support of the teachings herein, various analysis components may be used, including a digital and/or an analog system. For example, the one or more sensors 16, the surface computer processing system 15, and/or the downhole electronics 17, may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" are used to differentiate elements and do not denote a particular order.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for adjusting a drilling parameter of a drill string, the method comprising:

sensing with one or more sensors disposed at the drill string at least one of a first oscillation amplitude at a first position in the drill string and an oscillation parameter of the drill string, different from the first oscillation amplitude, at the first position or a second position in the drill string to provide at least one of measured first oscillation amplitude data and measured oscillation parameter data;

determining, with a processor, one or more modes of the drill string using a mathematical model;

identifying with the processor a mode of the drill string using the one or more determined modes and a stability criterion and at least one of the measured first oscillation amplitude data and the measured oscillation parameter data, wherein the stability criterion comprises a specific modal damping for each of the one or more determined modes, and wherein the specific modal damping for each of the one or more determined modes is derived by using at least one of the measured first oscillation amplitude data and the measured oscillation parameter data;

calculating, with the processor, an oscillation amplitude at a position of interest in the drill string using the identified mode and at least one of the measured first oscillation amplitude data, the measured oscillation parameter data and the stability criterion; and adjusting, with the processor, the drilling parameter in response to the calculated oscillation amplitude at the position of interest.

2. The method according to claim 1, wherein the oscillation parameter of the drill string, different from the first oscillation amplitude is at least one of a second oscillation amplitude at a second position in the drill string, a rotary speed of a rock cutting structure in the drill string, and an oscillation frequency at the first position in the drill string.

3. The method according to claim 2, wherein the rock cutting structure is at least one of a drill bit, a hole opener, and a reamer.

4. The method of claim 1, wherein the stability criterion comprises at least one of an eigenfrequency of the one or more determined modes, a deflection, and a force.

5. The method according to claim 1, wherein adjusting comprises adjusting the drilling parameter in response to the calculated oscillation amplitude at the position of interest exceeding a predefined threshold using the processor configured to adjust the drilling parameter.

6. The method according to claim 1, wherein the calculated oscillation amplitude at the position of interest is a torsional oscillation amplitude.

7. The method according to claim 1, further comprising extrapolating with the processor a sensed first oscillation amplitude to an excitation position using a predominant mode to provide an excitation oscillation amplitude at the excitation position.

8. The method according to claim 7, further comprising adjusting the drilling parameter in response to the excitation oscillation amplitude at the excitation position.

9. The method according to claim 7, further comprising calculating with the processor a normalized excitation oscillation amplitude at the excitation position normalized to a selected amplitude at the excitation position.

10. The method according to claim 9, wherein the selected amplitude is a worst-case amplitude or within a selected range of the worst-case amplitude.

11. The method according to claim 1, further comprising transmitting with a transmitter a signal to a surface receiver.

12. The method according to claim 11, wherein the signal is at least one of the measured first oscillation amplitude data, the measured oscillation parameter data and the calculated oscillation amplitude.

13. The method according to claim 1, wherein the drilling parameter comprises at least one of drill string rotational speed, mud-motor rotational speed, drill bit rotational speed, drill string torque, drilling fluid flow rate, hook-load, weight-on-bit, torque-on-bit, weight on a rock cutting structure, and torque on the rock cutting structure.

14. The method according to claim 1, wherein the position of interest in the drill string is a position of a downhole tool.

15. The method according to claim 1, wherein sensing the first oscillation amplitude to provide measured first oscillation amplitude data comprises sensing at least one of acceleration, bending moment, displacement, velocity, torque, strain, and stress.

16. The method according to claim 1, further comprising recording the drilling parameter versus time and at least one of the measured first oscillation amplitude data versus time and the measured oscillation parameter data versus time; further using the recordings to determine a correlation between variations in a value of the drilling parameter and at least one of variations of the measured first oscillation amplitude data and variations of the measured oscillation parameter data.

17. An apparatus for adjusting a drilling parameter of a drill string, the apparatus comprising:

a sensor configured to sense at least one of a first oscillation amplitude at a first position in a drill string and an oscillation parameter of the drill string, different from the first oscillation amplitude, at the first position or a second position in the drill string to provide at least one of measured first oscillation amplitude data and measured oscillation parameter data;

a processor configured to:

determine one or more modes of the drill string using a mathematical model;

identify a mode of the drill string using the one or more determined modes and a stability criterion and at least one of the measured first oscillation amplitude data and the measured oscillation parameter data, wherein the stability criterion comprises a specific modal damping for each of the one or more determined modes, and wherein the specific modal damping for each of the one or more determined modes is derived by using at least one of the measured first oscillation amplitude data and the measured oscillation parameter data;

calculate an oscillation amplitude at a position of interest in the drill string using the identified mode and at least one of the measured first oscillation amplitude data, the measured oscillation parameter data and the stability criterion; and adjust the drilling parameter in response to the calculated oscillation amplitude at the position of interest.

18. The apparatus according to claim 17, wherein the processor is configured to automatically adjust the drilling parameter in response to the calculated oscillation amplitude at the position of interest.

19. The apparatus according to claim 17, wherein the processor is configured to accept manual input from a user that receives the calculated oscillation amplitude at the position of interest.

* * * * *